US006891107B2

(12) United States Patent
Le Cloirec et al.

(10) Patent No.: US 6,891,107 B2
(45) Date of Patent: May 10, 2005

(54) DEVICE FOR ELECTRIC CONTACT FOR TEXTILE MATERIAL AND USE THEREOF FOR JOULE HEATING

(76) Inventors: Pierre Le Cloirec, 19, Rue Antoine de Saint-Exupery, La Chapelle sur Erdre (FR), 44240; Albert Subrenat, 43, Rue Jean Emile Laboureur, Nantes (FR), 44000

( * ) Notice: Subject to any disclaimer, the term of this patent is extended or adjusted under 35 U.S.C. 154(b) by 0 days.

(21) Appl. No.: 10/250,944

(22) PCT Filed: Jan. 18, 2002

(86) PCT No.: PCT/FR02/00196

§ 371 (c)(1),
(2), (4) Date: Jul. 9, 2003

(87) PCT Pub. No.: WO02/058194

PCT Pub. Date: Jul. 25, 2002

(65) Prior Publication Data

US 2004/0053518 A1 Mar. 18, 2004

(30) Foreign Application Priority Data

Jan. 19, 2001 (FR) ..... 01 00752

(51) Int. Cl.[7] ..... H01B 7/00
(52) U.S. Cl. ..... 174/110 R; 174/110 M
(58) Field of Search ..... 174/117 F, 117 FF, 174/36, 110 R, 113 R; 427/122, 287, 389.7

(56) References Cited

U.S. PATENT DOCUMENTS

| | | | | | |
|---|---|---|---|---|---|
| 4,324,602 | A | * | 4/1982 | Davis et al. | 156/71 |
| 4,367,585 | A | * | 1/1983 | Elliott et al. | 29/857 |
| 4,442,139 | A | * | 4/1984 | Brigham | 427/122 |
| 4,660,908 | A | | 4/1987 | Ballester | |
| 4,733,059 | A | * | 3/1988 | Goss et al. | 219/548 |
| 4,918,814 | A | * | 4/1990 | Redmond et al. | 29/878 |
| 6,080,267 | A | * | 6/2000 | Hope et al. | 156/305 |
| 6,414,286 | B2 | * | 7/2002 | Rock et al. | 219/545 |
| 6,734,363 | B1 | * | 5/2004 | Horton et al. | 174/117 F |

FOREIGN PATENT DOCUMENTS

| | | |
|---|---|---|
| EP | 0 477 069 | 3/1992 |
| EP | 0 574 310 | 12/1993 |
| FR | 2 588 127 | 4/1987 |

* cited by examiner

*Primary Examiner*—William H. Mayo, III
(74) *Attorney, Agent, or Firm*—Young & Thompson

(57) ABSTRACT

A device for electric contact between an electrical supply (5) and an electrically conductive flexible material (1) consisting for the major part of fibers. The material (1) is covered, on at least two separate overlapping zones (z1, z2), with a superimposition layer of electrically conductive adhesive and a metal strip (4). The device is used for electric heating of the material consisting for the major part of fibers (1) by Joule heating, for example for desorption of molecules previously adsorbed on said material (1).

20 Claims, 6 Drawing Sheets

DEVICE FOR ELECTRIC CONTACT FOR TEXTILE MATERIAL AND USE THEREOF FOR JOULE HEATING

BACKGROUND OF THE INVENTION

The present invention relates to a device for electrical contact between an electrical supply and a layer of flexible fibrous conductive material and the use of this device for heating by the Joule effect.

When it is desired to supply with electrical current ohmic conductive materials of the fibrous type, such as cloths, felts, composite needled materials, of carbon (activated or not), their structure, their surface condition and the absence of rigidity do not permit using conventional electrical contact techniques. Thus, it is not possible to provide directly points of soldering on their surface. It is also difficult to use screws or rivets without damaging the fibrous material, or altering its mechanical strength. For example, metallic clamps can give rise to tearing of the layer of fibrous material under the influence of tension or mechanical traction.

It is also not possible to use contacts of the rigid copper bar type with which it is difficult to control the pressure exerted on the fibrous material, nor to shape this latter. Moreover, such bars provide only weak contact with the irregular surface of the fibers of conductive material that it is desired to connect to an electrical supply. These drawbacks are amplified when the fibrous material, generally supple and very flexible, is of small thickness.

Moreover, in the case in which it is necessary to give to the layer of conductive material a non-planar shape, for example a curved or folded shape, it is also difficult to obtain continuous electrical contact over large lengths. This is particularly the case when said material is used for heating by the Joule effect, for which heating must be as homogeneous as possible, hence one should obtain the most homogeneous possible distribution of current in the cloth over all the length of the contact. The result of this effect will give a current transmission as homogeneous as possible over all the surface of the material extending between the two electrical contacts.

SUMMARY OF THE INVENTION

An object of the present invention is accordingly to overcome the mentioned drawbacks by providing a device permitting providing effective electrical contact between an electrical a supply of continuous or alternating electrical current and a layer of flexible conductive material which is mostly fibrous, without damaging the fibrous material nor altering its mechanical strength.

Another object of the present invention is to propose a device permitting providing a substantially continuous zone of electrical contact between said fibrous material and the electrical supply.

According to the invention, these objects are achieved with the device for electrical contact between an electrical supply and a layer of electrically conductive flexible material that is principally fibrous, which is characterized in that the material is covered, over at least two separate overlapping zones, with a superposition of a layer of an electrically conductive adhesive and a metallic strip. Thus the presence of the conductive adhesive which follows exactly the irregularities of the surface of the fibrous material, permits an electrical contact at a multiplicity of points (and thus a substantially continuous contact) between the fibrous material and the metallic strip, hence electrically conductive, over all the overlapping zone. The layer of adhesive permits both securing the metallic strip to the fibrous material and permitting the passage of current between these two latter. The adhesive can be constituted principally of a glue or resin that is itself conductive, or a glue or resin doped for example with silver, copper or graphite . . . or else a glue or a resin enclosing (micro)particles that are electrically conductive.

Preferably, the separated overlapping zones are disposed diametrically opposed, so as to permit the passage of the electrical current over the whole, or at least over a major portion of the layer of said fibrous material.

Preferably, the total thickness of the device permits its bending at the level of the overlapping zone of the adhesive and of the metallic strip. This bending can be a fold, a scalloping, a rolling of the layer on itself or on a support, or any other shaping that the flexibility of the layer of fibrous material permits. The thickness of the superposition of the metallic strip and of the adhesive layer can be comprised within a wide range extending from 0.001 mm to 5 mm, and more particularly between 0.05 mm and 2 mm, the fibrous material being adapted to have a thickness comprised between 0.1 mm and 10 mm, preferably between 0.4 mm and 5 mm.

The intensity of delivered current is a function of the contact resistance between the metallic strip and the principally fibrous material and also depends on the width of the overlapping region. This width can be comprised between 0.001 mm (strip in the form of a filament) and about 500 mm (flat strip). It is important when said contact resistance or the resistivity of the conductive adhesive used is high. This width will also be important if it is necessary to have high delivered power in the fibrous material.

However, if the strip is in the form of a filament, it is necessary to multiply the number of connections with the electrical supply.

With the device according to the invention, the overlapping region, because of its superposed structure, permits rigidifying the fibrous material and thus the conventional connections to an electrical supply can be used: metallic clamps, soldering, rivets, screws, etc . . . without harming said material. Preferably, this connection can be at a single point or at a multiplicity of points. A single point is preferred, for technical and economical reasons, the metallic strip preferably distributing the current over all the length of the overlapping region.

According to a modified embodiment of the device according to the invention, between the principally fibrous material and the adhesive layer, said material is coated with a conductive varnish, at least in said overlapping zone. The role of this varnish is principally to rigidify the contact, to improve the inter-fiber contact, and hence to decrease the electrical contact resistance whilst smoothing the surface of the fibrous material. Thus the mechanical and electrical contacts between said fibrous material and the adhesive are improved, as also the contacts between the fibrous material and the electrical supply.

According to another modification of the device according to the invention, this device can be embedded in an electrically and/or thermally insulating material. In this case, either the insulating material is provided with at least one perforation permitting connection to the electrical supply, for example by screwing or riveting, cable terminal or pin of the "banana" type, or else the device is embedded with its connection in the insulating material.

Preferably, the metallic strip has a resistivity comprised approximately between $10^{-8}$ and $10^{-4}$ Ω.m, preferably comprised between $10^{-7}$ and $10^{-4}$ Ω.m. In all cases, the resistance of this strip must be less than the contact resistance on the fibrous material. Said strip can for example be copper, zinc, aluminum, silver, nickel, iron, nickel-chrome, lead based, or any other suitable material for its properties that are at the same time electrical, thermal and mechanical or based on an alloy of these metals. The metallic strip can also be replaced by an electrically conductive polymer material.

For better electrical transfer between the electrical supply and the fibrous material, the adhesive and the varnish must have a resistivity that is overall less than that of said fibrous material. They can enclose for example conductive (micro) particles which ensure very numerous contact points of very low electrical resistance.

Said principally fibrous material usable in the present invention can be selected from carbon or activated carbon materials in the form of a cloth, a felt or an agglomerate of fibers. Their resistivity is generally of the order of $10^{-4}$ to $10^{-1}$ Ω.m.

This principally fibrous material can be reinforced with a mesh, a grill or another non-conductive mechanically reinforcing material. Said reinforcing material can be for example polypropylene, cellulosic fibers, glass or quartz fibers.

An interesting use of the device according to the present invention is during electrical heating of the principally fibrous material by the Joule effect. The electrically conductive fibrous material then serves as a heating element, and can be used for example for radiant panels, internal elements of ovens, chimneys, tailpipes, etc . . . .

If the fibrous material is also an adsorbent material (based on activated carbon for example) and has previously adsorbed molecules (for example odorific organic molecules and/or pollutants), the heating of the latter permits the release by desorption of these adsorbed molecules, and thus the regeneration of said material. It is also possible to use the device simply to measure the resistance or the electrical resistivity of this type of fibrous material. Another use of the device according to the invention relates to the retrieval of combustible molecules previously stored within the fibrous material.

The device according to the present invention can also be used for the polarization of a fibrous surface, for example for electrostatic capture of particles and dust.

The fibrous material provided with the device according to the invention can also be used as an electrode in an electrolytic bath.

BRIEF DESCRIPTION OF THE DRAWINGS

The present invention will now be better explained by non-limiting examples, with reference to the illustrative figures in which all the elements have been enlarged for better understanding. In the latter.

DESCRIPTION OF THE PREFERRED EMBODIMENTS

Figure 1:
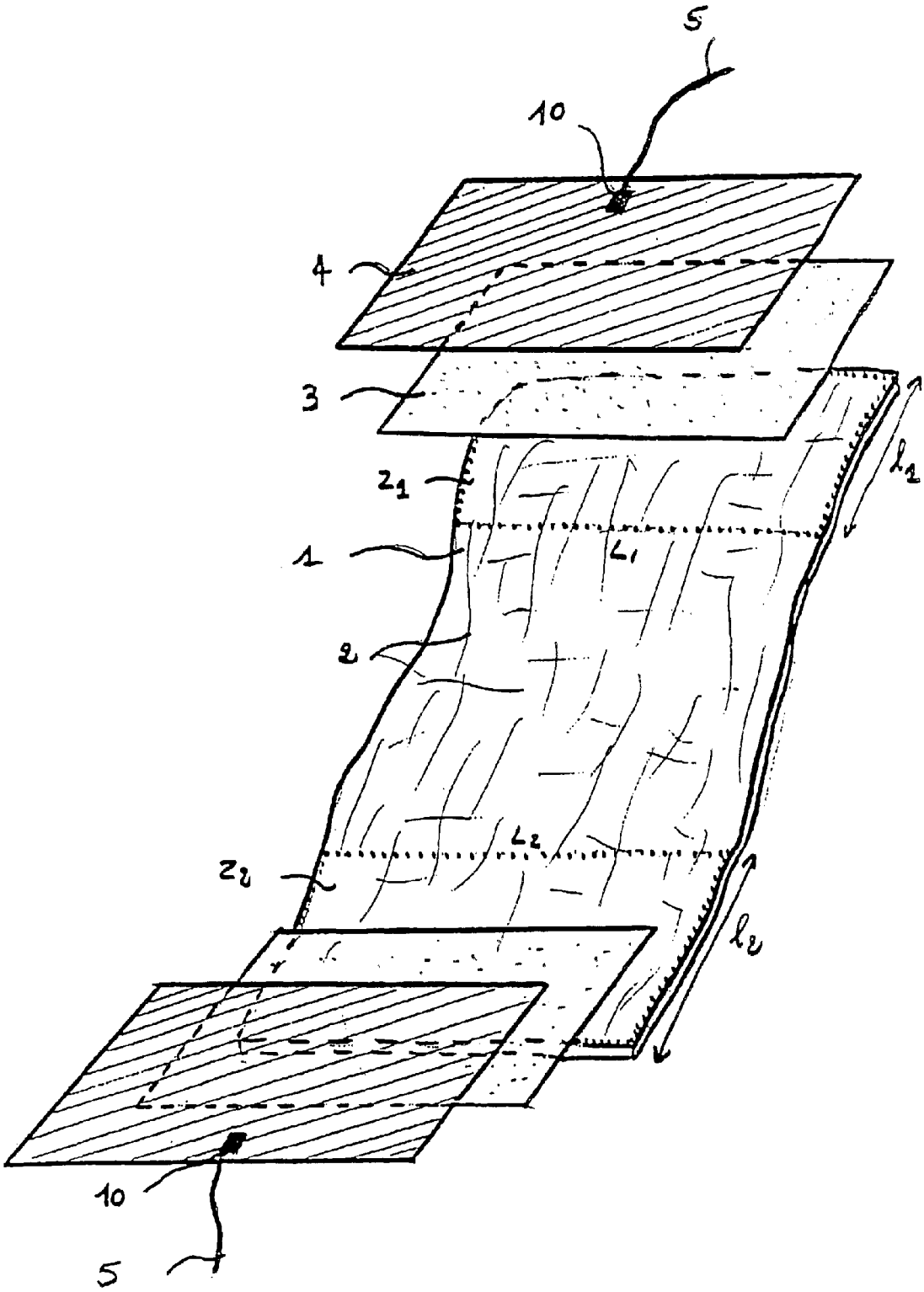
FIG. 1 shows, in an exploded view, the superposition of the layers forming the device of the invention.

According to the invention shown in FIG. 1, the fibrous material (1) is a carbon cloth (activated or not), here constituted by woven fibers (warp and weft) (2). This material (1) which is electrically conductive (of a resistivity of the order of $10^{-3}$ Ω.m) is covered, over two overlapping regions $Z_1$ and $Z_2$ of a width $l_1$ and $l_2$, located at the two opposed ends of the carbon cloth (1), with a conductive acrylic base adhesive (3), itself covered with a metallic strip (4) here of copper. The dimensions of this metallic strip (4) correspond to those of the respective overlapping regions of a width $l_1$, $l_2$ and a length $L_1$, $L_2$. The thickness of the copper strip (4) is in this example about 35 μm and its width ($l_1$, $l_2$) of 19 mm, its resistivity is of the order of $1.7\times10^{-8}$ Ω.m.

There can be used as flexible metallic strip/adhesive for example a commercial metallic strip, used for blinding electrical cable connections against electromagnetic interference, the grounding and the draining of electrical charges. In this case this assembly of metallic strip/adhesive has the principal role of ensuring the transmission of the current between the electrical supply (5) and the fibrous material (1).

Figure 2:
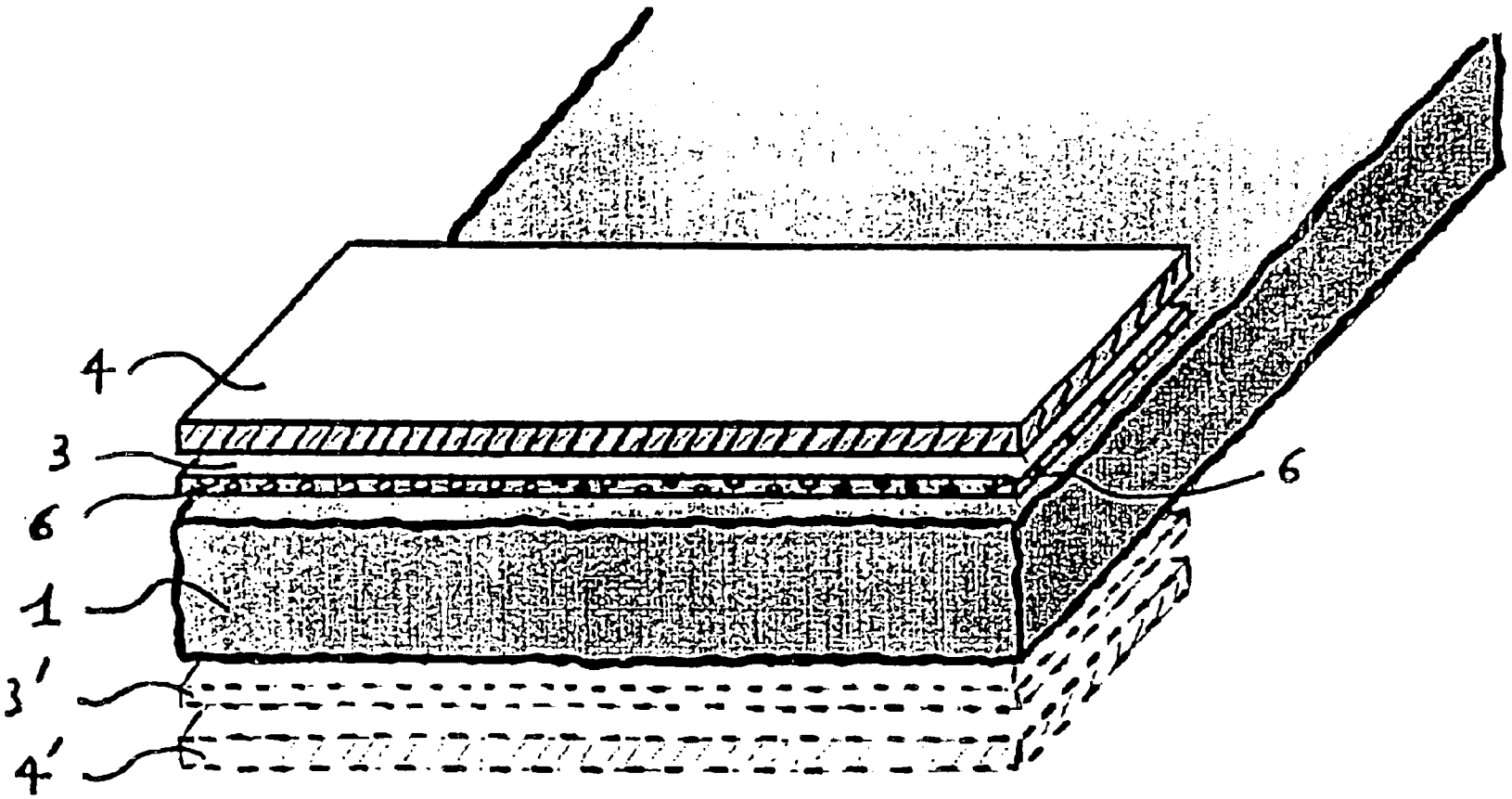
FIG. 2 shows in cross-section the superposition of the layers of the device at the region of overlap.

The adhesive is an acrylic base glue enclosing conductive microparticles (6) as shown in cross-section in FIG. 2. The resistivity through this adhesive is of the order of $5.10^{-3}$ Ω.m.

It is to be noted that the device according to the invention can be doubled, which is to say provided on its two surfaces with the fibrous material (1), as schematically shown in broken lines in FIG. 2 (adhesive (3') and metallic strip (4')). According to another preferred arrangement, not shown, the overlapping regions $Z_1$ and $Z_2$ can be located, still at opposite ends of the fibrous material (1), one on one surface of said material, the other on the other surface of the same material, thereby permitting better electrical flow through this fibrous material.

Figure 3:
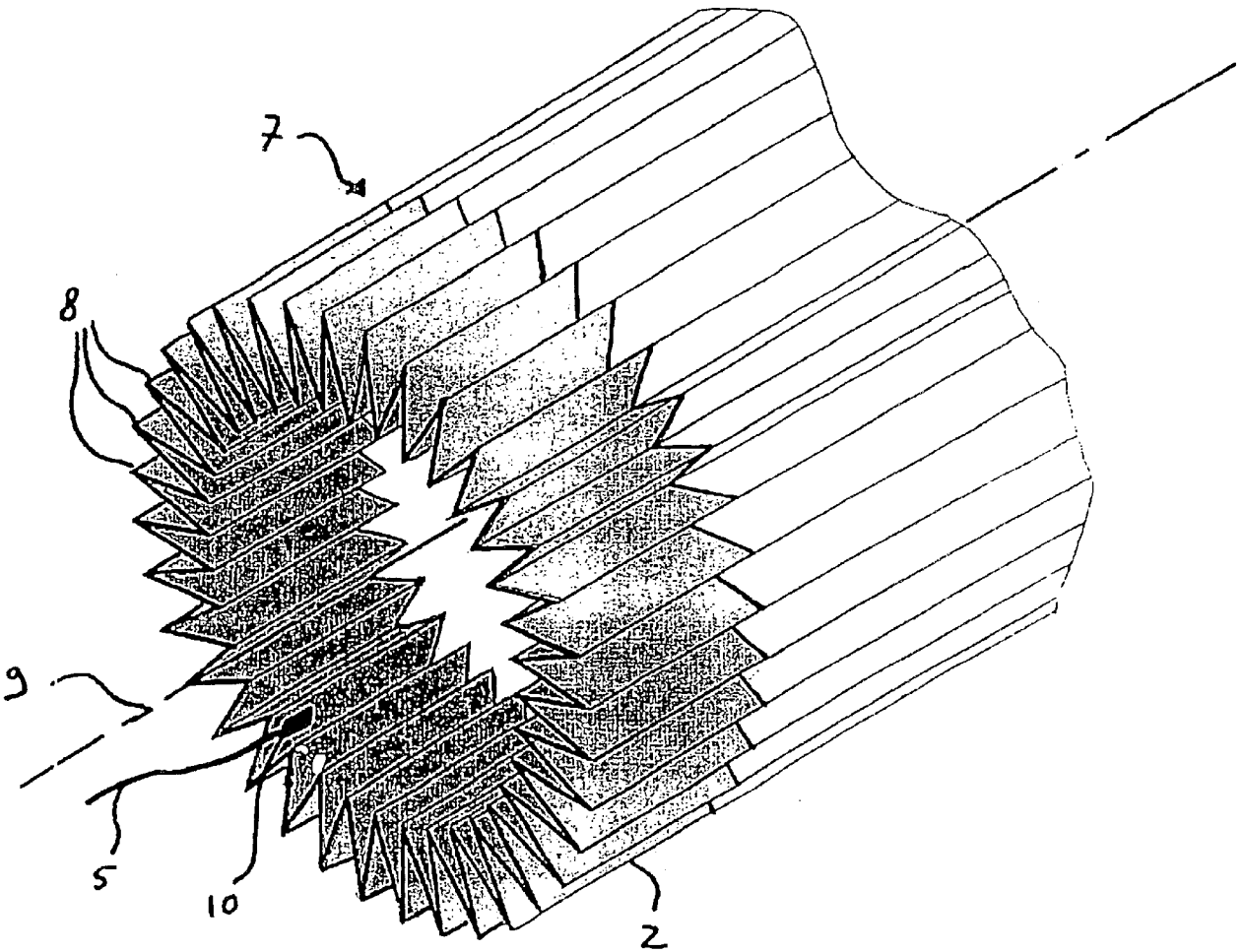
FIG. 3 shows in perspective an example of an arrangement by bending the device.

In the case in which the carbon cloth (1) will serve as an adsorbent material (for example if the fibrous material is a cloth or felt based on activated carbon) it is interesting to have the largest exchange surface possible with minimum size. It can thus be advantageous for example to roll up said material on itself or else fold it or pleat it. FIG. 3 shows such an arrangement by pleating. The fibrous material (1), here having the overall shape of a cylinder (7), is pleated at a multitude of folds (8) parallel to each other and parallel to the axis (9) of said cylinder (7). The device according to the invention can be disposed at the two ends of said cylinder (7), on regions of overlapping (z) located either within or without the cylinder, or else one within and the other without, or else within the interior and the exterior of this cylinder at each end.

The connection (10) with the electrical supply (5) is in this case provided at a single point, by means of soldering at the surface of the metallic strip (4), at each of the ends of said cylinder (7), of which only one end is shown in FIG. 3.

Figure 4:
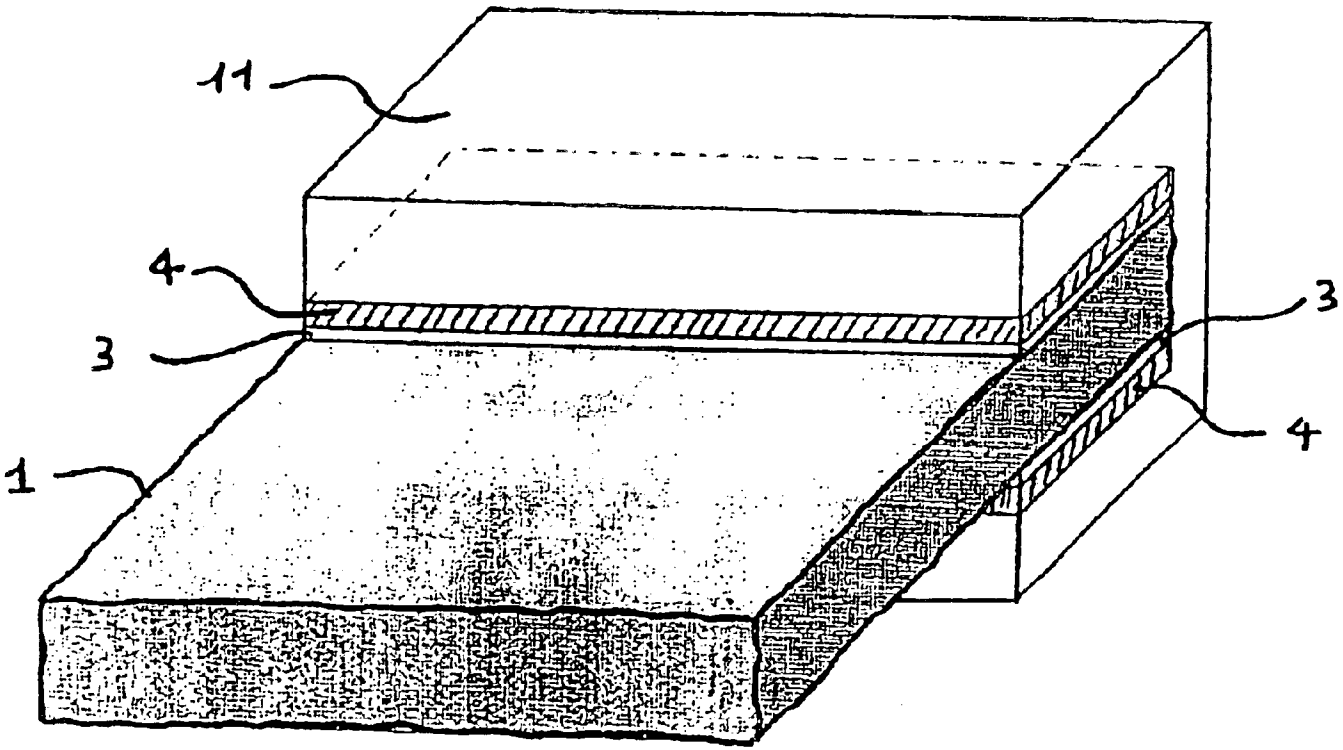
FIG. 4 shows in perspective a modification of the device of the invention embedded in an insulating material.

FIG. 4 shows a modification of the device according to the invention, in which the superposition of a fibrous material (1), sandwiched between two couples of conductive adhesive (3)/metallic strip (4), is embedded in a material (11) which is both electrically and thermally insulating, which is for example an epoxy resin.

Figure 5A:
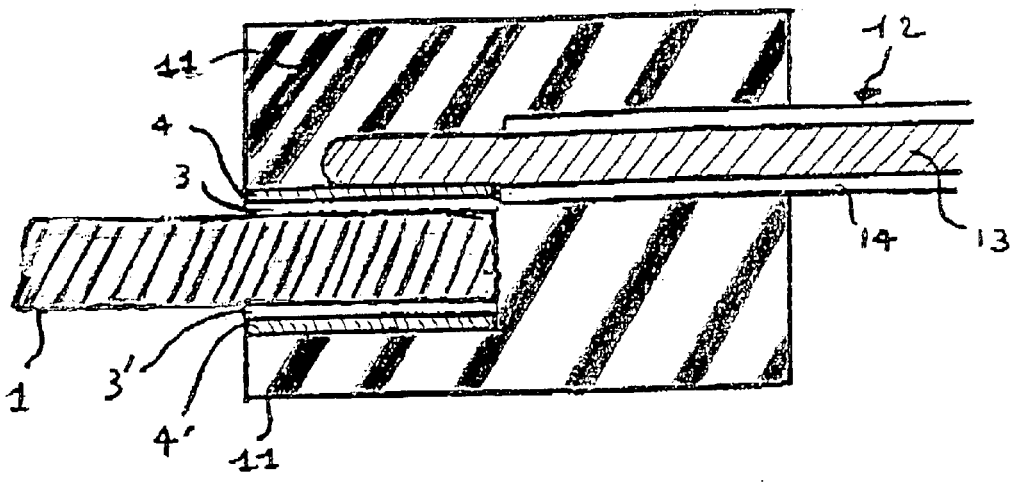
FIGS. 5*a* and 5*b* show in cross-section two examples of connection of the device to the electrical supply.
Figure 5B:
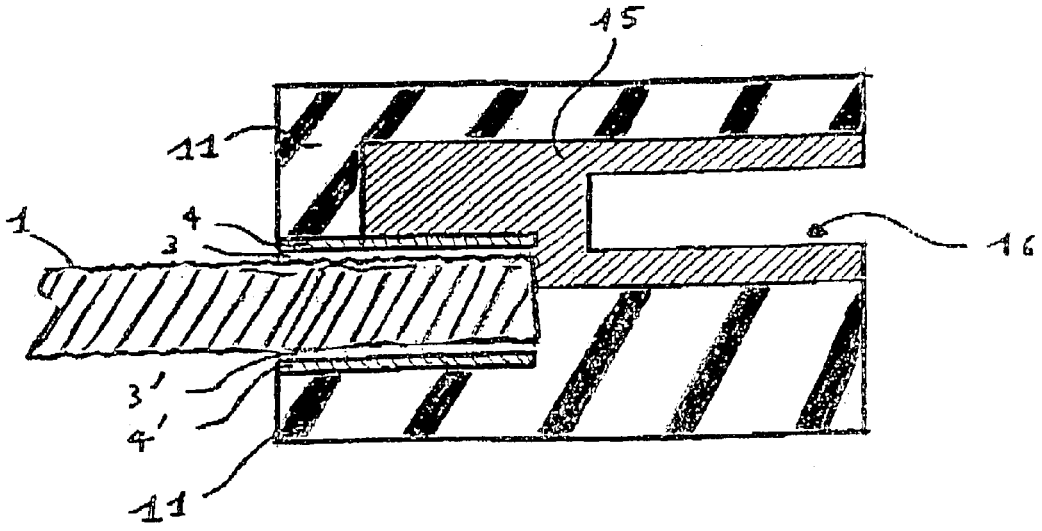

This type of assembly permits particularly cladding and protecting the connection of the electrical supply. FIGS. 5*a* and 5*b* show two examples of connection. In FIG. 5*a*, it is the electrical supply cable (12) which is directly connected to one of the metallic strips (4) by means of soldering the wires (13) of said cable, after having removed the insulating sheath (14). In the example of FIG. 5*b*, a connective element (15) is soldered to one of the metallic strips (4) before being embedded in the insulating material (11). This element (15) has a female portion (16) which communicates with the outside of the block of insulating material (11) and permits receiving a pin of the "banana" type (not shown), of a cable connected to the electrical supply.

The fibrous material (1), generally supple and very flexible, can be reinforced by lamination with a more mechanically resistant material (18). Such a modification is shown in FIG. 6, in which the laminated portion (19) is disposed opposite the zone of overlap of the adhesive (3) and the metallic strip (4) of the device according to the invention, relative to the fibrous material (1).

Figure 6:
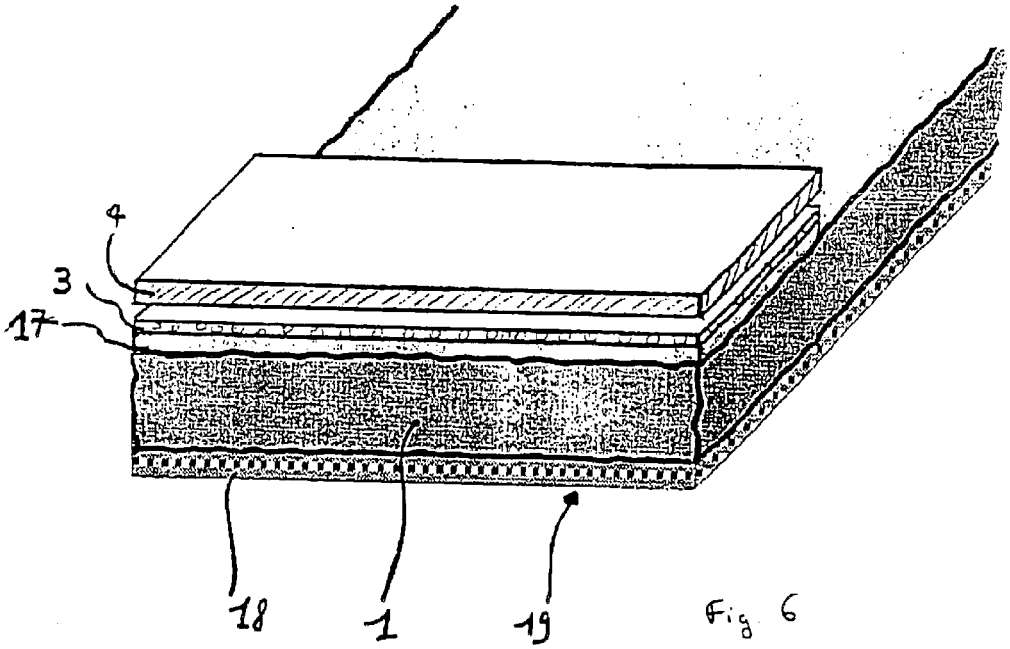
FIG. 6 shows in perspective a reinforced fibrous material.

In FIG. 6 is also shown another modification according to which the fibrous material (1) is covered, over at least one of its surfaces, with a conductive varnish (17), on which is thus disposed the superposition of the adhesive (3) and of the conductive strip (4) (in this figure, the strip has been offset upwardly of the figure relative to its effective position, for better clarity).

The arrangements according to the two last modifications can be present simultaneously or not.

Figure 7:
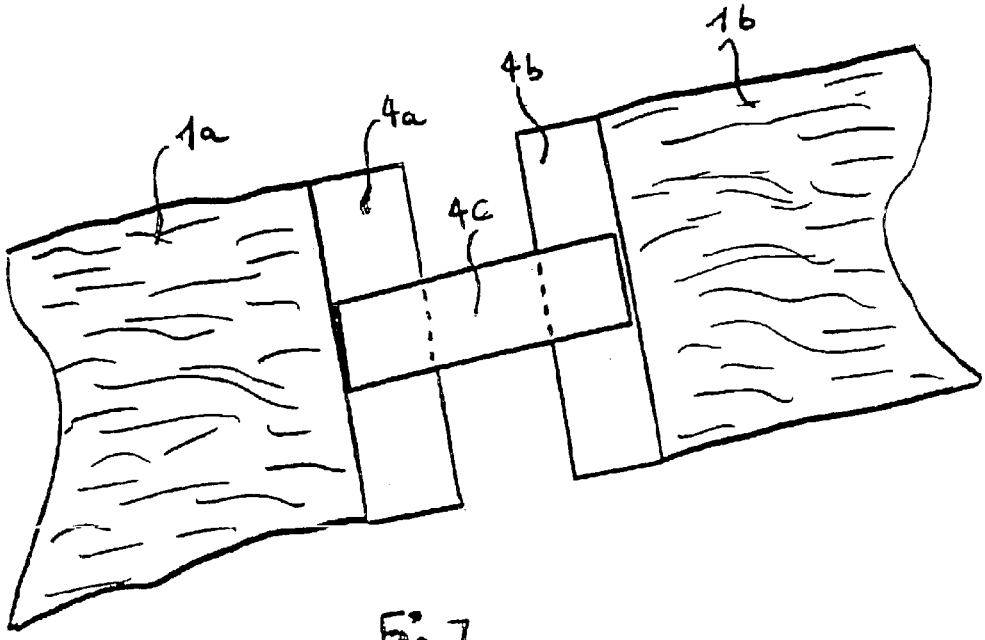
FIG. 7 shows a connection between two modules of fibrous material by means of a supplemental device according to the present invention.

The device according to the present invention can also serve as an electrical contact between two modules of fibrous materials (1*a* and 1*b*) that are identical or different. An example is shown schematically in FIG. 7. The two fibrous materials (1*a* and 1*b*) are provided at their adjacent ends with a device according to the invention (conductive adhesive respective couples (3*a*, 3*b*) (not shown)/metallic strip (4*a*, 4*b*)) between which is secured, by gluing by means also of a conductive adhesive (not shown), a supplemental device comprising at least one (preferably two) metallic strip (4*c*). Such an arrangement is used for example for placing in series Joule effect heating modules for the desorption of molecules previously adsorbed on the cloths or felts of activated carbon.

Examples of Embodiment

There is used a device as shown in FIG. 1, in which the constituents have the following characteristics:

metallic strip (4) of copper of resistivity $1.7\times10^{-8}$ Ω.m at 20° C. of a width $l_1=l_2=19$ mm and of a thickness 0.035 mm adhesive (3) (acrylic base containing conductive particles) of a resistance of 0.005 Ω and of a thickness 0.031 mm, fibrous material (1) of activated carbon cloth of a resistivity of $16\times10^{-4}$ Ω.m at 20° C. and of a thickness 0.5 mm.

What is claimed is:

1. Device for electrical contact between an electrical supply (5) and a layer of electrically conductive flexible material (1) which is principally fibrous, characterized in that the material (1) is covered, over at least two separated overlapping regions ($Z_1$, $Z_2$), with a superposed layer of an electrically conductive adhesive (3) and a metallic strip (4).

2. Device for electrical contact according to claim 1, characterized in that a total thickness of said material (1) permits a bending of said material (1) at the overlapping region ($Z_1$, $Z_2$) of the adhesive (3) and the metallic strip (4).

3. Device for electrical contact according to claim 1, characterized in that between the principally fibrous material (1) and the adhesive layer (3), said material (1) is coated with a conductive varnish (17), at least in said overlapping region ($Z_1$, $Z_2$).

4. Device for electrical contact according to claim 1, characterized in that the metallic strip (4) has a resistivity comprised approximately between $10^{-8}$ and $10^{-4}$ Ω.m.

5. Device for electrical contact according to claim 1, characterized in that the metallic strip (4) is of copper, zinc, aluminum, silver, nickel, chromium, iron, lead base or an alloy of these metals.

6. Device for electrical contact according to claim 1, characterized in that said metallic strip is embedded in an electrically and/or thermally insulating material (11).

7. Device for electrical contact according to claim 6, characterized in that the insulating material (11) is provided with at least one perforation permitting connection to the electrical supply (5), by screwing or riveting.

8. Device for electrical contact according to claim 6, characterized in that said metallic strip is embedded with a connection (10) to the electric supply in the insulating material (11).

9. Device for electrical contact according to claim 1, characterized in that the principally fibrous material (1) can be reinforced with a mesh, a grill or a network of another mechanically reinforcing non-conductive material (18).

10. Device for electrical contact according to claim 9, characterized in that said reinforcing material (18) is polypropylene, cellulosic fibers, glass or quartz fibers.

11. Device for electrical contact according to claim 1, characterized in that said principally fibrous material (1) is selected from a cloth, a felt or an agglomerate of fibers (2), of carbon or activated carbon and said fibrous material has a resistivity in an order of $10^{-4}$ to $10^{-1}$ Ω.m.

12. The use of the device according to claim 1 for electrical heating of principally fibrous material by the Joule effect.

13. The use according to claim 12 for radiant panels.

14. The use according to claim 12 for internal elements of ovens, chimneys or exhaust pipes.

15. The use according to claim 12 for the regeneration of the fibrous material (1).

16. The use according to claim 12 for releasing combustible molecules previously stored within the fibrous material (1).

17. The use of the device according to claim 1, for the polarization of a fibrous surface.

18. The use of the device according to claim 1, for a fibrous material serving as an electrode in an electrolytic bath.

19. Device for electrical contact, comprising:

a fibrous, electrically conductive, flexible material forming a first layer;

a first region of an electrically conductive adhesive (3) adhered to the material of the first layer;

a first metallic strip adhered to the first region of the electrically conductive adhesive;

a first connection (10) for connecting the first metallic strip to an electrical supply (5);

a second region of the electrically conductive adhesive (3) adhered to the material of the first layer, the first and second regions being separated from each other;

a second metallic strip adhered to the second region of the electrically conductive adhesive, the first and second metallic strips being separated from each other; and a second connection (10) for connecting the second metallic strip to the electrical supply.

20. The device of claim 19, wherein, said material has a resistivity in an order of $10^{-4}$ to $10^{-1}$ Ω.m.

* * * * *